US005787514A

United States Patent [19]

Erli

[11] Patent Number: 5,787,514

[45] Date of Patent: Aug. 4, 1998

[54] REDUCTION SEAT FOR CHAMBER POTS OR TOILET BOWLS

[75] Inventor: Pier Angelo Erli, Telgate, Italy

[73] Assignee: Stamp S.R.L., Bergamo, Italy

[21] Appl. No.: 636,018

[22] Filed: Apr. 22, 1996

[30] Foreign Application Priority Data

Dec. 15, 1995 [IT] Italy ..... MI95A2644

[51] Int. Cl.[6] ..... A47K 13/00

[52] U.S. Cl. ..... 4/239; 4/245.1; 4/237

[58] Field of Search ..... 4/239, 245.1, 245.3, 4/234, 237, 245.5

[56] References Cited

U.S. PATENT DOCUMENTS

| | | | |
|---|---|---|---|
| 1,441,719 | 5/1923 | Almorth . | |
| 1,633,222 | 7/1927 | Noble . | |
| 2,255,272 | 3/1941 | Rasmussen . | |
| 3,261,031 | 7/1966 | Blem et al. | 4/239 |
| 4,525,880 | 7/1985 | Bass | 4/239 |
| 5,005,223 | 4/1991 | Greenwood | 4/239 |
| 5,090,063 | 2/1992 | Edwards et al. | 4/239 |
| 5,136,731 | 8/1992 | Caro et al. . | |
| 5,267,355 | 12/1993 | Landman | 4/239 |

*Primary Examiner*—David J. Walczak

*Attorney, Agent, or Firm*—Laff, Whitesel, Conte & Saret, Ltd.

[57] ABSTRACT

A reduction seat for chamber pots or toilet bowls comprises a plurality of substantially stiff portions (2*a*, 2*b*, 3*a*, 3*b*) adapted to be selectively disposed in an engagement position on a sanitary bowl, in which they are substantially in coplanar relation with each other, and in a folded position for transport, and application means (12*a*, 12*b*) comprising stiff engagement elements (13*a*, 13*b*) adapted to abut at mutually facing positions against an upper rim (4*b*) of the sanitary bowl.

11 Claims, 3 Drawing Sheets

2b
8a
8b
15a
15b
2a 2b
3a
3b
2a 3c
3a
2c
3b
2a 2b
2c
2a 12b
8b
3c
8a
3
2c
12a
2c
2

15b
12b
13a
15a

REDUCTION SEAT FOR CHAMBER POTS OR TOILET BOWLS

BACKGROUND OF THE INVENTION

1. Field of the Invention

The present invention relates to a reduction seat for chamber pots or toilet bowls of the type comprising a plurality of substantially stiff portions which are at least partly mutually connected in a manner adapted to selectively dispose them in a use position at which they are substantially in coplanar relation with each other, and a transport non-use position at which they are folded, and means for application of the same to a sanitary pot or bowel.

2. Prior Art

It is known that the use of chamber pots and/or toilet bowls (in the following generally referred to as "sanitary bowls") above all in public environments or premises represents a difficulty for children, due to the inappropriate sizes of said sanitary bowls; in addition this use often is also considered as a source of great worry from an hygienical point of view.

In an attempt to solve the above problems, portable reduction seats have been already known which are made of plastic material and consist of four stiff portions, each substantially corresponding to a quarter of an annulus, said portions being mutually linked at the ends at three hinging areas so that they can be selectively disposed in a use position at which they are substantially coplanar with each other and a folded position for transportation in which said stiff portions are overlapped wich each other so as to reduce the seat bulkiness.

Generally, the reduction seat of known type are further provided with means for application of the same to a sanitary bowl, which means consists of a pair of suction cups for example, capable of adhering to the upper edge of said bowl.

The known art briefly described above has some drawbacks.

Actually, first of all the reduction seat of the known type offers a rather unsafe and unreliable use when applied to a sanitary bowl, so that an adult is obliged to constantly assist a child and a careful control is necessary for avoiding the occurrence of displacements of the seat from the initial positioning. In addition the size and shape of known reducers leaves wide contact areas between the user and the sanitary bowl surface.

Furthermore, the initial positioning step of the reduction seat onto the sanitary bowl requires a certain degree of precision and accuracy which often cannot be easily achieved, due to places and circumstances.

Finally, the reduction seats of known type, as a result of their intrinsic structure, are rather unstable and therefore uncomfortable for a child in need of them.

SUMMARY OF THE INVENTION

Under this situation, the technical task underlying the present invention is to devise a reduction seat for sanitary bowls capable of substantially obviating the above drawbacks.

The technical task specified is substantially achieved by a reduction seat for sanitary bowls wherein said application means comprises at least one pair of fastening devices disposed in opposite relationship and each having at least one stiff engagement element, said stiff engagement elements being adapted to abut at mutually facing positions against an upper rim of said sanitary bowl.

BRIEF DESCRIPTION OF THE DRAWINGS

The description of a preferred and non-exclusive embodiment of a reduction seat for sanitary bowls in accordance with the invention is given hereinafter by way of non-limiting example with reference to the accompanying drawings, in which.

DESCRIPTION OF THE PREFERRED EMBODIMENT

Figure 1:
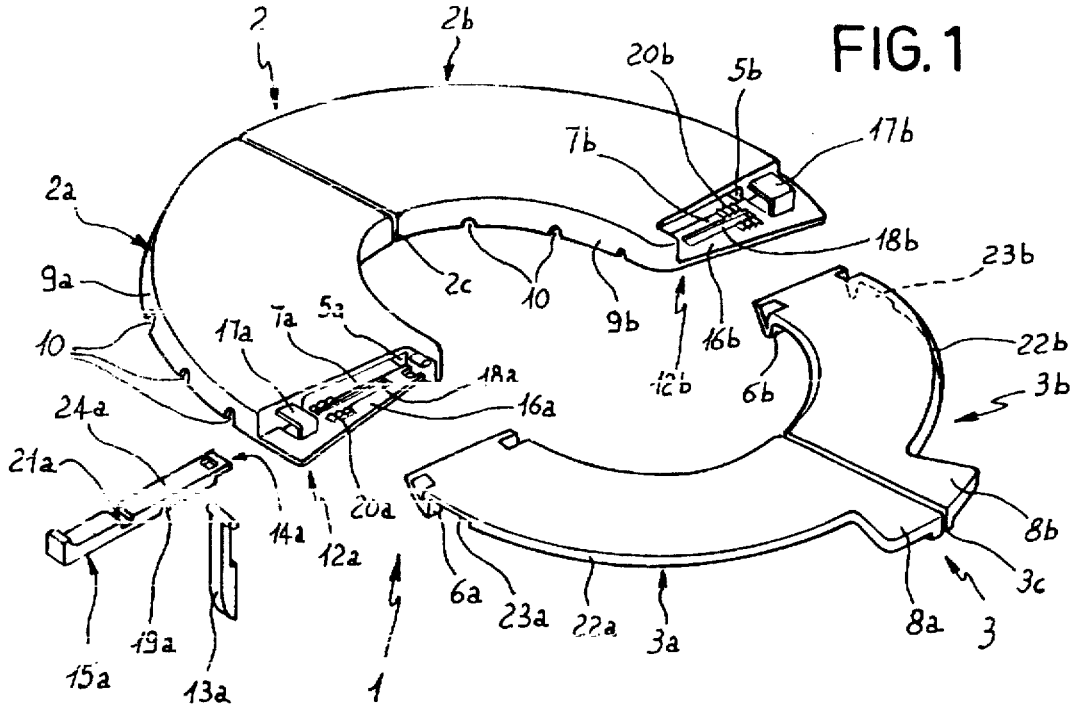
FIG. 1 is an exploded perspective view of the reduction seat according to the invention.

Referring to the drawings, the reduction seat for sanitary bowls in accordance with the invention is generally identified by reference numeral 1.

It comprises four stiff portions 2*a*, 2*b*, 3*a* and 3*b*, moulded from plastic material such as polypropylene for example, each substantially corresponding to a quarter of an annulus.

Said stiff portions by pairs substantially are part of a front half 2 intended for positioning at the front of a sanitary bowl 4, and a rear half 3 respectively, each of them substantially extending through a straight angle.

Each pair of stiff portions belonging to one half has a hinging area 2*c* and 3*c*, practically consisting of a connecting area of reduced thickness, and therefore foldable, of the same stiff portions.

Figure 2:
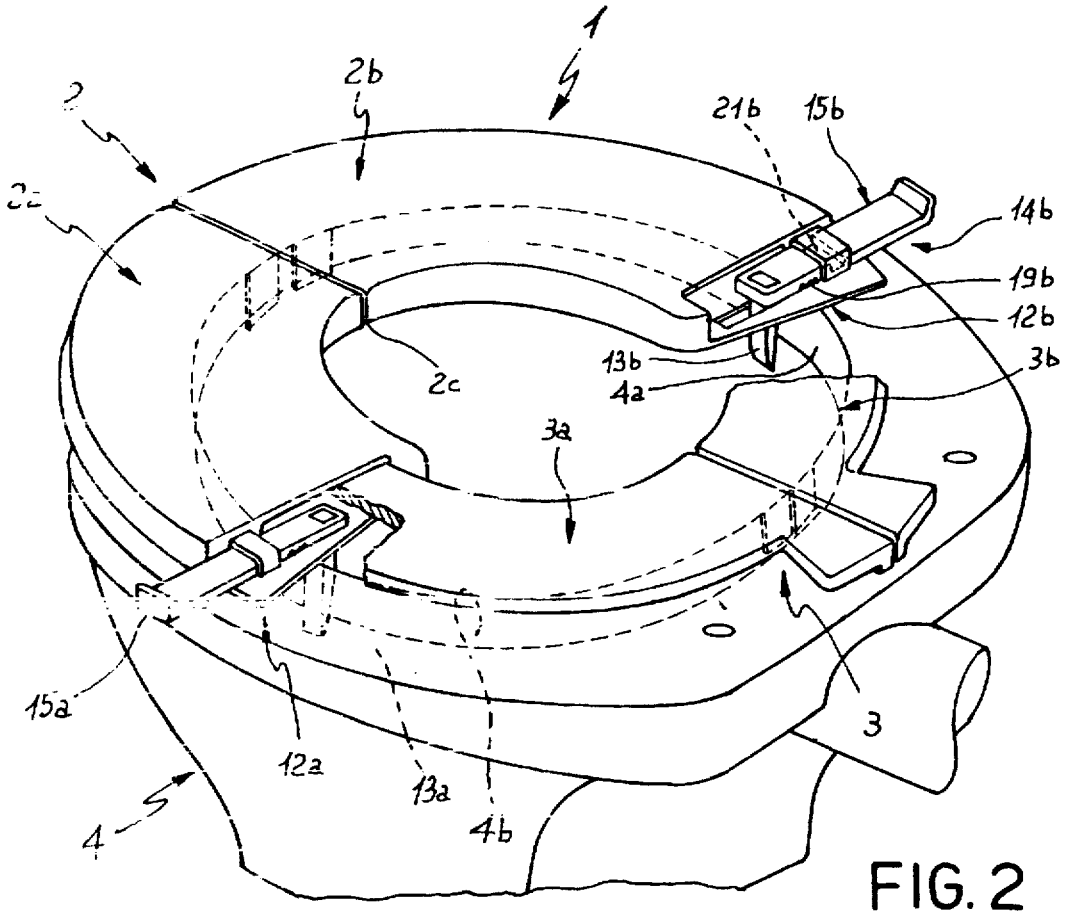
FIG. 2 is a perspective view of the seat shown in FIG. 1 applied to a toilet bowl.

The hinging areas 2*c* and 3*c* extend radially and are diametrically aligned in the use position of the seat (see FIG. 2.)

In addition, these hinging areas of reduced thickness are located, in the use position, at the lower faces of the stiff portions, so that they impose folding of halves 2 and 3 in a direction adapted to make said lower faces of the stiff portions of each half to match with each other in the folded transport position (see FIGS. 3 and 4) so that any of said reducer's parts that have been brought into contact with a bowl 4 will never be in contact with the user's hands thereby ensuring a quite hygienic handling. It is to note that as an alternative solution to the above, the use of traditional hinges is in any case possible.

Each stiff portion of each half is slidably coupled with a respective stiff portion of the other half. More particularly, portion 2*a* is coupled with portion 3*a* and portion 2*b* is coupled with portion 3*b* so that they can selectively slide on the respective coupling portions between a position of substantial superposition, shown in FIG. 3, corresponding to the transport position and an extension position corresponding to the use position in which the hinging areas 2*c* and 3*c* are, as already said, diametrically aligned (see FIGS. 5, 6, 7 for example).

In order to achieve the above couplings, the stiff portions 2*a* and 2*b* of the front half 2 have respective hollows 5*a* and 5*b*, faced downwardly in the use position and adapted to slidably house the corresponding portions 3*a* and 3*b* of the rear half 3.

Said portions 3a and 3b are provided at the ends with hooking regions 6a and 6b that, once fitted into the hollows 5a and 5b during the assembling step, constitute locators abutting against respective strips 7a and 7b arranged to close said hollows and adapted to prevent portions 3a and 3b from completely slipping out of portions 2a and 2b, respectively.

Portions 3a and 3b are further provided, close to the hinge region 3c, with extensions 8a and 8b radially projecting outwardly adapted to constitute the grasping end of the same portions during the opening and closing operations of the seat and insertable, in a use position, between the attachment screws of the tip-up ring-like seat, with which a sanitary bowl is usually equipped.

Obviously, expansions 8a, 8b also constitute a further anchoring point of the reducer to the bowl 4 thereby increasing the reducer steadiness. The stiff portions 2a and 2b are peripherally surrounded by circular borders 9a and 9b projecting downwardly in said use position and matching with each other in said folded transport position.

Advantageously the projecting borders 9a and 9b have a plurality of openings 10 adapted to define passageways enabling flowing of a sanitizing liquid in the hollows 5a and 5b, which liquid can be held in a container and into which the seat 1 is dipped in a folded position; said container can be embodied by a case 11 or a holding box (not shown) also adapted for transportation of the seat 1 itself.

Said seat 1 further comprises means for application to a sanitary bowl 4 defined by at least one pair of fastening devices 12a and 12b located at opposite positions with respect to each other and at the end of halves 2 and 3.

More particularly, the fastening devices 12a and 12b comprise respective stiff engagement elements 13a and 13b, adapted to abut at mutually facing positions against an inner band 4a of an upper rim 4b of the sanitary bowl 4, and operating means 14a and 14b capable of disposing said engagement elements 13a and 13b in a plurality of adjustable fastening positions, depending on the sanitary bowl 4 sizes, that is on the distance between the opposite side portions of the inner band 4a.

The operating means 14a and 14b, in turn, comprises respective drive members 15a and 15b in the form of buttons, radially movable on slide seating 16a and 16b formed in the respective portions 2a and 2b and provided with elongated guide holes 17a and 17b.

The engagement elements 13a and 13b are rotatably connected at the respective ends to the extremity of the drive buttons 15a and 15b facing the inside of the seat in a use position and can be received, in the folded position for transport, into respective recesses formed at the lower part of said drive buttons 15a and 15b.

In more detail, the slide seatings 16a and 16b have slots 18a and 18b adapted for passage of the engagement elements 13a and 13b from their position within the lower recesses of the drive buttons 15a and 15b to their fastening position substantially perpendicular to the buttons themselves. Also formed in said buttons is a plurality of adjustment notches 19a and 19b corresponding to the different operating positions that the engagement elements 13a and 13b can take and adapted to selectively and elastically interfere with locking elements 20a and 20b.

Practically the drive buttons 15a and 15b are shiftable from a folded transport position (shown in FIG. 3, for example), in which they are retracted within the overall dimensions of the respective stiff portions 2a or 2b, the engagement elements 13a and 13b being also retracted in the recesses provided in the drive buttons, to a plurality of operating positions resulting from an outward translation of the seat, determined by the adjustment notches 19a and 19b and corresponding to a plurality of fastening adjustments of the engagement elements 13a and 13b, perpendicularly to the drive buttons.

Finally, the drive buttons 15a and 15b have suitably-arranged hollow housings 21a and 21b at the upper part thereof, so as to enable sliding therein of external borders 22a and 22b projecting downwardly from the stiff portions 3a and 3b, when said drive buttons are in a retracted position and do not project from the respective stiff portions 2a and 2b. The external borders 22a and 22b in turn are provided at the respective ends, close to the hooking regions 6a and 6b, with indentations 23a and 23b capable of releasing the hollow housings 21a and 21b from the borders 22a and 22b, thereby enabling translation of the drive buttons 15a and 15b.

Said drive buttons in an outwardly translated operating position are disposed against the ends of the external borders 22a and 22b, in register with interference areas 24a and 24b, thereby locking the respective stiff portions 3a and 3b to said extension position with respect to portions 2a and 2b.

An operating use of a reduction seat described above mainly as regards structure is as follows.

Figures 3, 4, 5, 6, 7, 8:
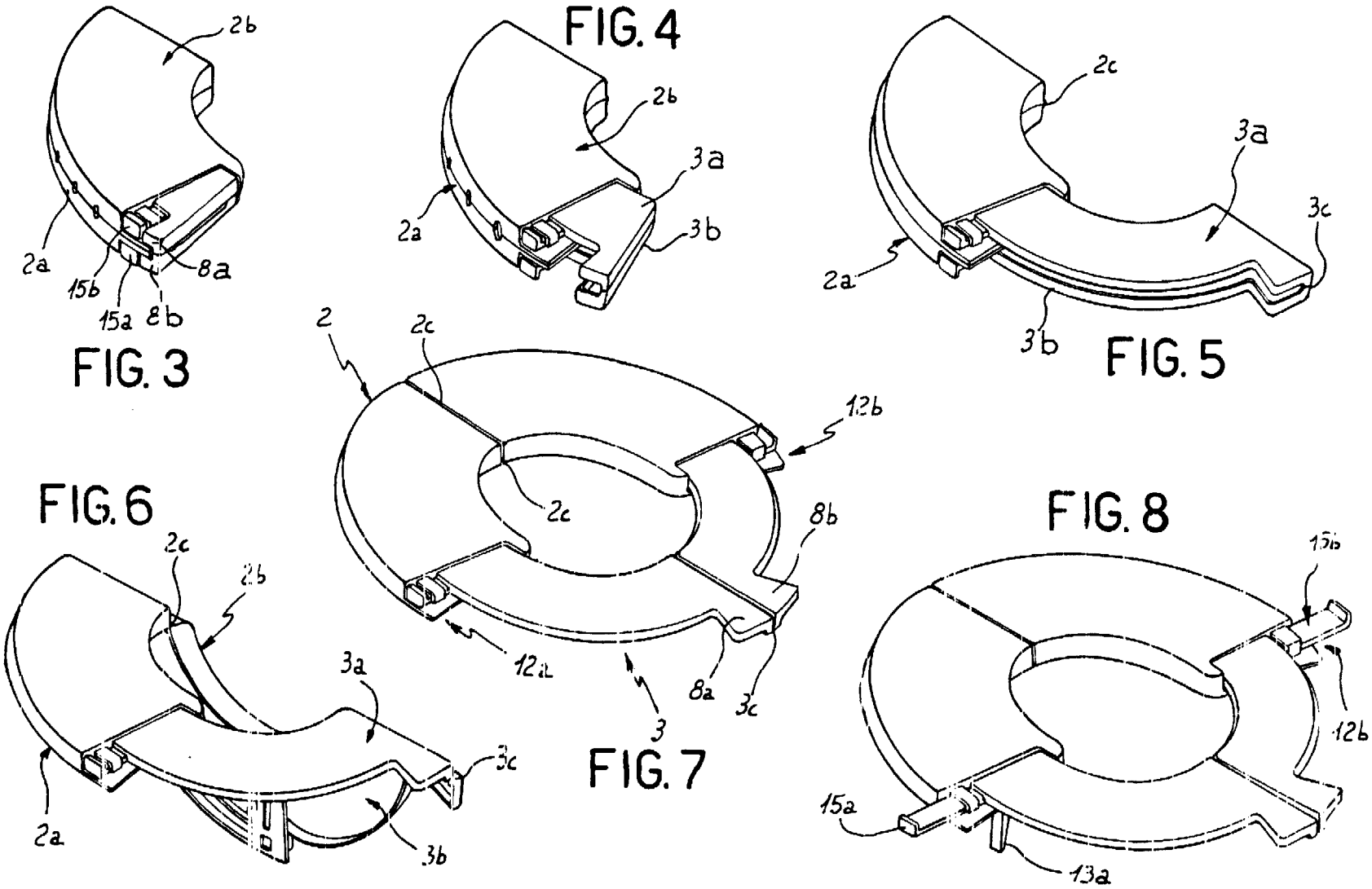
FIG. 3 is a perspective view of the seat shown in FIG. 1 in a folded transport position.
FIGS. 4, 5, 6 and 7 are perspective views of the seat in FIG. 1 showing the successive operating steps required for achievement of a use position.
FIG. 8 reproduces the step of fastening the seat shown in FIG. 1 to a sanitary bowl.
Figure 9:
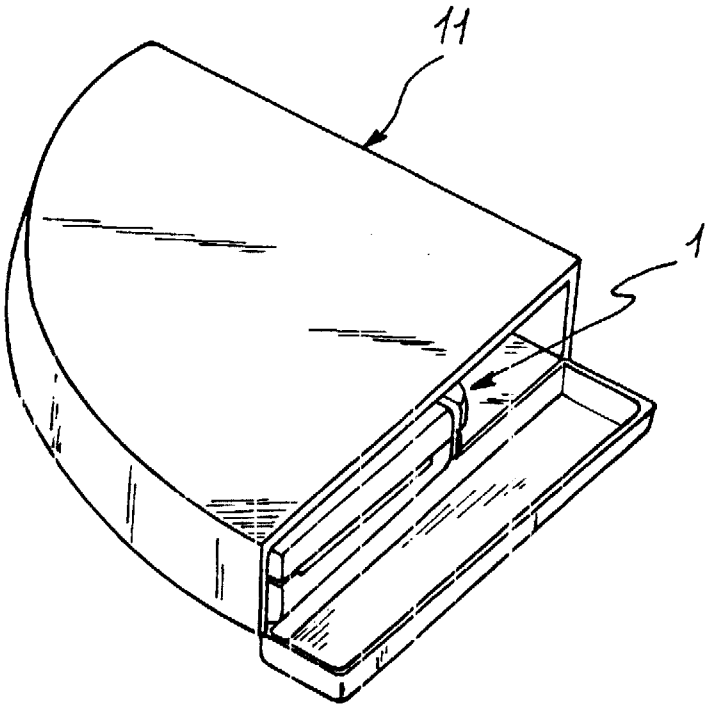
FIG. 9 is a diagrammatic perspective view of an open case adapted to house the seat for transportation.
Figure 10:
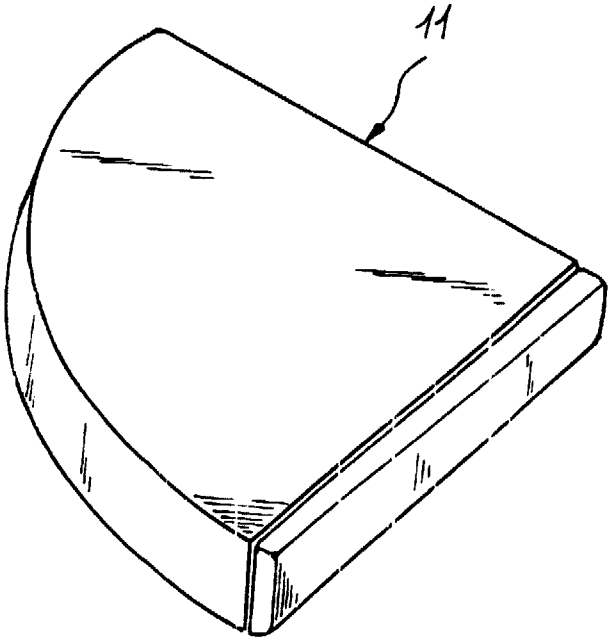
FIG. 10 shows the case of FIG. 9 in a closed position.

In a folded transport position the reduction seat 1 is substantially in the form of a quarter of an annulus, the stiff portions 3a and 3b of the rear half 3 being fitted in the respectif stiff portions 2a and 2b of the front half 2 which in turn are in superposed relationship (see FIG. 3)

By gripping the extensions 8a and 8b the stiff portions 3a and 3b are drawn out by sliding from the front half 2 until the hooking regions 6a and 6b are brought against the abutment strips 7a and 7b and the hinging area 3c of the rear half 3 is diametrically in alignment with the hinging area 2c (see FIGS. 4 and 5).

Only in this alignment position a complete opening of the seat can take place so that the four stiff portions forming it are arranged in coplanar relationship and therefore are ready for use (see FIGS. 6, 7).

By simultaneously acting on both the drive buttons 15a and 15b in a single operating step the seat is brough into engagement with the inner band 4a of the sanitary bowl. In fact by translating the drive buttons 15a and 15b outwardly the engagement elements 13a and 13b are disposed in register with the respective slots 18a and 18b and, by a 90 degree rotation, they emerge downwardly taking their fastening position (see FIG. 8).

After laying the seat on the upper rim of a sanitary bowl 4 the drive buttons are acted upon and pulled outwardly until the engagement elements 13a and 13b abut against the inner band 4a of bowl 4. Once this position has been reached, the locking elements 20a and 20b mate with the respective adjustment notches 19a and 19b, and the drive buttons 15a and 15b with the respective engagement elements 13a and 13b are immobilized and exert opposite thrusts against the inner band 4a of the bowl so that the seat 1 is firmly locked thereto (see FIG. 2) It is pointed out that in the engagement position the hollow housings 21a and 21b of the drive buttons 15a and 15b are out of alignment with respect to the external borders 22a and 22b of the stiff portions 3a and 3b, so that the latter cannot re-enter the hollows 5a and 5b provided in portions 2a and 2b of the front half After the use of the reduction seat, the previous operating steps are reversely repeated until the seat is brought back to its folded transport position. During these operations, the lower faces of the seat that have come into contact with the sanitary bowl remain opposite each other so that they will never be touched by the hands of the person carrying out folding, thereby ensuring the greatest hygiene.

Finally, the seat in its folded transport position can be fitted into the appropriate case 11 in which serialization of same can be executed by pouring a sanitizing liquid thereinto. The openings 10 on the circular borders 9*a* and 9*b* enable an appropriate circulation of the sanitizing liquid also in the hollows 5*a* and 5*b* of portions 2*a* and 2*b* and along the surfaces of the rigid portions 3*a* and 3*b* of the rear half 3.

The invention achieves important advantages.

In fact, in addition to being of easy and quick use, the reduction seat of the invention also enables a safe anchoring to a chamber pot, due to the facility of adjusting its size.

In addition, the reduction seat in its use condition offers a great steadiness that increases comfort to a child in need of it and also a wide seat base preventing the user from getting into contact with the sanitary bowl.

Finally it will be recognized that acting on the fastening devices is very practical because it does not require a particular care since the engagement elements come automatically into contact with the sanitary bowl firmly, anchoring the seat thereto once the seat has been laid on said bowl even if not in a centered position.

In carrying out the invention practically, the materials, shapes and sizes can be of any nature and magnitude depending on requirements.

Many modifications and variations may be made to the invention as conceived, all of them falling within the scope of the inventive idea characterizing it.

What is claimed is:

1. A reduction seat for chamber pots or toilet bowls, comprising two halves (2, 3), each of said two halves having a pair of substantially stiff portions (2*a*, 2*b*, 3*a*, 3*b*) which are at least partly mutually connected in a manner adapted to selectively dispose said stiff portions in a use position in which said stiff portions are substantially in coplanar relation with each other and a transport non-use position in which said stiff portions are folded, each stiff portion substantially corresponding to a quarter of an annulus and each pair of each half having a radially extending hinging area (2*c*, 3*c*), application means (12*a*, 12*b*) for application to a sanitary bowl wherein said application means comprises at least one pair of fastening devices (12*a*, 12*b*) disposed in opposite relation and each having at least one stiff engagement element (13*a*, 13*b*), said stiff engagement elements being adapted to abut at mutually facing positions against an upper rim (4*b*) of said sanitary bowl, each stiff portion (2*a*, 2*b*) of one half (2) is slidably coupled with a respective stiff portion (3*a*, 3*b*) of the other half (3) so that the stiff portions (2*a*, 2*b*) of the one (2) can selectively slide on the respective stiff portions (3*a*, 3*b*) of the other half (3) from a position corresponding to said folded transport position, in which said stiff portions are substantially superposed with each other to an extension position corresponding to said use position in which said hinging areas (2*c*, 3*c*) are in linear alignment.

2. The seat as claimed in claim 1, wherein each of said fastening devices (12*a*, 12*b*) comprises operating means (14*a*, 14*b*) for said engagement element (13*a*, 13*b*), adapted to dispose said engagement element according to a plurality of adjustable fastening positions depending on a size of the sanitary bowl.

3. The seat as claimed in claim 2, wherein said operating means (14*a*, 14*b*) comprises a drive member (15*a*, 15*b*) shiftable between a folded transport position in which said drive member is retracted within an overall dimension of said stiff portions (2*a*, 2*b*) and also causes retraction within said overall dimension of said engagement element (13*a*, 13*b*), and a plurality of operating positions corresponding to said fastening positions of the engagement element.

4. The seat as claimed in claim 3, wherein said drive member (15*a*, 15*b*) is in the form of a button and is radially movable outwardly of the seat in an engagement position so that said engagement element (13*a*, 13*b*) is adapted to abut against an inner face of upper rim (4*b*) of the sanitary bowl, substantially perpendicularly to the button itself.

5. The seat as claimed in claim 4, wherein said operating means (14*a*, 14*b*) comprises:

a slide seating (16*a*, 16*b*) for said drive button (15*a*, 15*b*) formed in one (2*a*, 2*b*) of said stiff portion of the seat itself, a plurality of adjustment notches (19*a*, 19*b*) formed in said drive button (15*a*, 15*b*) and corresponding to said plurality of operating positions, and a locking element (20*a*, 20*b*) adapted to elastically interfere with at least one of said adjustment notches (19*a*, 19*b*).

6. The seat as claimed in claim 5, wherein said engagement element (13*a*, 13*b*) is rotatably connected at an end with an extremity of said drive button (15*a*, 15*b*) facing an inside of the seat in an engagement position, and said drive button has a longitudinal recess adapted to receive said engagement element in said folded transport position, and in that said slide seating (16*a*, 16*b*) of the drive button (15*a*, 15*b*) has a slot (18*a*, 18*b*) adapted to enable passage of said engagement element (13*a*, 13*b*) from said longitudinal recess to said fastening position.

7. The seat as claimed in claim 1, wherein the stiff portions (2*a*, 2*b*) of one said half (2) have a hollow (5*a*, 5*b*) at the lower part thereof which is adapted to slidably house the respective stiff portion (3*a*, 3*b*) of the other half (3).

8. The seat as claimed in claim 7, wherein said stiff portions (2*a*, 2*b*) provided with a hollow (5*a*, 5*b*) are peripherally surrounded by borders (9*a*, 9*b*) projecting downwardly in said use position and matching with each other in said folded transport position and in that said projecting borders (9*a*, 9*b*) have a plurality of openings (10) adapted to enable circulation in said hollows (5*a*, 5*b*) of a sanitizing fluid held in a container (11) and intended for dipping of the seat in a folded condition thereinto.

9. The seat as claimed in claim 7, wherein the half comprising said stiff portions (2*a*, 2*b*) provided with a hollow (5*a*, 5*b*) is designed to be positioned at the front on said sanitary bowl and in that each of said stiff portions (3*a*, 3*b*) of the half (3) intended for being positioned at the rear has a radially outwardly projecting extension (8*a*, 8*b*) close to its hinging area (3*c*).

10. The seat as claimed in claim 1, wherein said fastening devices (12*a*, 12*b*) are disposed at the end of said halves (2*a*, 2*b*) and each comprise a drive member (15*a*, 15*b*) for said engagement element (13*a*, 13*b*) which has an interference area (24*a*, 24*b*) arranged to lock two respective stiff portions (2*a*, 3*a*, 2*b*, 3*b*) of the two halves (2, 3) in said extension position.

11. The seat as claimed in claim 1, wherein said hinging areas (2*c*, 3*c*) of said stiff portions (2*a*, 2*b*, 3*a*, 3*b*) impose folding of said halves (2, 3) in a manner adapted to make the faces of the stiff portions of each half (2, 3) that are in contact with the bowl when the seat is in its use position, match with each other when said seat is in its folded transport position.

* * * * *